US005705311A

United States Patent [19]

Young

[11] Patent Number: 5,705,311

[45] Date of Patent: Jan. 6, 1998

[54] HEAT-DEVELOPABLE IMAGE-RECORDING ELEMENT

[75] Inventor: Kent M. Young, Carlisle, Mass.

[73] Assignee: Polaroid Corporation, Cambridge, Mass.

[21] Appl. No.: 607,288

[22] Filed: Feb. 26, 1996

[51] Int. Cl.[6] ..... G03C 8/06; G03C 8/40

[52] U.S. Cl. ..... 430/203; 430/230; 430/234

[58] Field of Search ..... 430/203, 230, 430/234

[56] References Cited

U.S. PATENT DOCUMENTS

| | | | |
|---|---|---|---|
| 3,050,391 | 8/1962 | Thompson et al. | 96/61 |
| 3,140,179 | 7/1964 | Russell | 96/68 |
| 3,188,209 | 6/1965 | Land et al. | 96/3 |
| 3,260,598 | 7/1966 | Yutzy et al. | 430/203 |
| 3,663,228 | 5/1972 | Wyckoff | 430/509 |
| 3,694,204 | 9/1972 | Farney et al. | 430/203 |
| 3,751,255 | 8/1973 | Wilson et al. | 96/66 R |
| 3,960,558 | 6/1976 | Cardone | 96/3 |
| 4,003,744 | 1/1977 | Kliem | 96/29 D |
| 4,347,301 | 8/1982 | Kliem | 430/215 |
| 4,639,407 | 1/1987 | Aono et al. | 430/203 |
| 4,654,297 | 3/1987 | Inoue | 430/230 |
| 4,740,363 | 4/1988 | Hirai et al. | 423/641 |
| 4,740,445 | 4/1988 | Hirai et al. | 430/203 |
| 4,772,535 | 9/1988 | Yamano et al. | 430/230 |
| 4,876,171 | 10/1989 | Hirai | 430/203 |
| 5,068,165 | 11/1991 | Coppens et al. | 430/203 |
| 5,308,738 | 5/1994 | De Keyzer et al. | 430/230 |
| 5,322,759 | 6/1994 | Barnett et al. | 430/230 |
| 5,382,501 | 1/1995 | Inoie | 430/506 |

FOREIGN PATENT DOCUMENTS

| | | |
|---|---|---|
| 0 011 645 B1 | 5/1983 | European Pat. Off. . |
| 0 187 879 B1 | 4/1988 | European Pat. Off. . |

*Primary Examiner*—Richard L. Schilling

*Attorney, Agent, or Firm*—Gaetano D. Maccarone

[57] ABSTRACT

A heat developable photosensitive image-recording element is described comprising photosensitive silver halide, either as the only source of silver present or in association with a substantially light-insensitive source of silver, a reducing agent, a silver solvent and an image-receiving layer including silver nucleating material. The total amount of silver present is arranged in two adjacent discrete layers, one of which includes the silver reducing agent and the other of which does not. The image-recording element provides an image having significantly increased image density upon exposure and photographic processing.

11 Claims, 1 Drawing Sheet

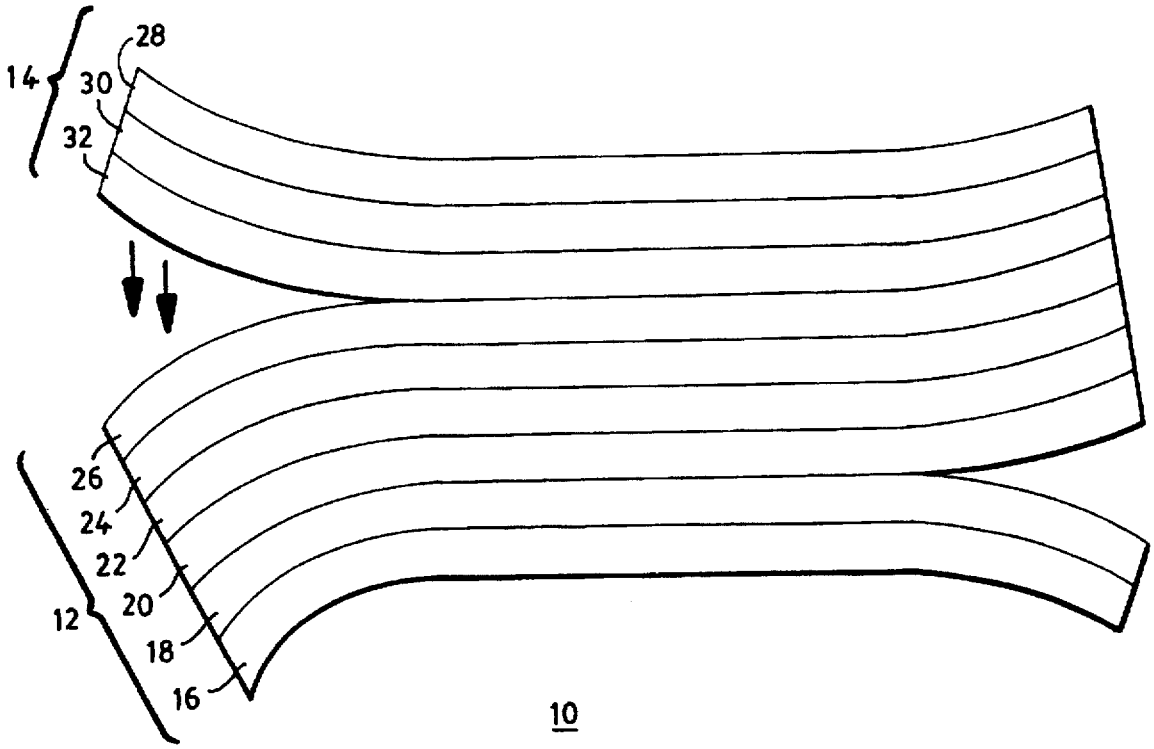
28
14
30
32
26
24
22
20
12
18
16
10

HEAT-DEVELOPABLE IMAGE-RECORDING ELEMENT

BACKGROUND OF THE DISCLOSURE

The application is directed to a photosensitive silver halide image-recording element and, more particularly, to a heat developable silver halide image-recording element wherein a silver image is formed in an image-receiving layer.

Photothermographic image-recording materials which include silver halide for forming images are known in the art. Such materials typically comprise a support carrying a photosensitive silver halide emulsion and a silver halide developing agent. A visible image is formed in these materials by exposing the photosensitive silver halide to an imagewise pattern of activating light to form a latent image and subsequently applying heat to the element in the presence of the developing agent.

Photothermographic materials can be generally divided into two classes. The first class of materials utilize silver halide as the sole source of silver. That is, silver halide not only functions as light-sensitive material for forming a latent image, but also serves as the sole source of silver for forming a final image, e.g. the light-sensitive silver may be developed to form a final negative image in reduced (metallic) silver. Materials of this sort typically include a polymeric support including in one or several layers: (a) a silver halide emulsion, (b) a developing agent for converting the exposed silver halide to metallic silver, and (c) an alkaline activator to obtain a pH at which the silver halide can be effectively developed. Similarly, silver diffusion transfer systems are known wherein unexposed silver halide is dissolved and transferred to a separate layer where it is subsequently reduced to form a positive final image in reduced silver.

The second class of photothermographic materials utilize light-sensitive silver halide for forming a latent image upon exposure, but unlike the first class of materials just described, this second class of materials also utilizes a non light-sensitive source of silver, i.e., a silver salt such as silver behenate for forming an image. With such materials the exposed photosensitive silver halide, upon being heated, catalyzes an oxidation-reduction reaction between the non light-sensitive silver salt and the developing agent to form a visible image. Examples of such photothermographic image-recording materials are disclosed in U.S. Pat. Nos. 3,751,255, 4,260,677 and 4,639,407 wherein images in metallic silver are formed by imagewise reduction of silver ions provided by a light-insensitive silver salt.

As the state of the art for photothermographic image-recording materials continues to move forward, new techniques and materials continue to be developed by those skilled in the art in order to meet the performance criteria required of such materials. The present invention is drawn to a novel heat-developable photosensitive silver halide image-recording element.

SUMMARY OF THE INVENTION

There is provided according to the invention a heat-developable, image-recording element which includes photosensitive silver halide, either as the only source of silver present or in association with a substantially light-insensitive source of silver such as a silver salt, a reducing agent (or silver halide developing agent), a silver halide solvent, and an image-receiving layer including silver nucleating material. The total amount of silver present in the element is divided between two adjacent discrete layers, one of which includes the silver reducing agent and the other of which does not. By distributing the silver in this manner, the image-recording element provides art image in the image-receiving layer which has significantly increased image density.

In a particularly preferred embodiment of the invention the entire amount of silver in the image-recording element is photosensitive silver halide which is divided between two adjacent layers. In another embodiment one layer contains photosensitive silver halide and an adjacent layer contains a substantially light-insensitive source of photosensitive silver.

In operation, the photosensitive silver halide is exposed to an imagewise pattern of activating electromagnetic radiation and the image-recording element subsequently developed at elevated temperature in the presence of alkali whereby there is formed in the image-receiving layer a visible image in metallic silver. The exposed photosensitive silver halide, when developed at elevated temperature, is reduced to metallic silver and remains in its original location in the image-recording element whereas the unexposed photosensitive silver halide is complexed by the silver halide solvent and transfers to the image-receiving layer. At the nucleating sites in the image-receiving layer, the soluble silver complex is developed and the complexed silver is reduced to metallic silver. Thus, there are formed in the image-recording element two complementary black silver images. As will be described in detail hereinafter, it is possible to provide a positive or negative image as a transparency or a reflection print. Further, the image-recording element may be an integral element wherein the entire element is retained intact after exposure and processing in which case there is arranged a light-reflecting layer between the complementary black silver images to allow each to be viewed. The image-recording element may also be a "peel-apart" element wherein the photosensitive element and a second element which includes the image-receiving layer are separated after such processing. In this embodiment there is preferably included a strip-coat layer between the locations where the complementary black silver images are formed to facilitate separation of the respective elements.

The alkaline environment required for development may be provided by any of a number of known techniques. For example, alkali may be generated in situ in the manner described in U.S. Pat. Nos. 3,260,598, 4,740,363 and 4,740,445. It is preferred to generate the alkali in situ by incorporating an alkali-generating system in the image-recording element. Alternatively, an aqueous alkaline processing composition may be distributed to the image-recording element after exposure of the photosensitive silver halide such as from a rupturable container as is well known in the diffusion transfer photographic art.

BRIEF DESCRIPTION OF THE DRAWINGS

For a better understanding of the invention as well as other objects and further features thereof; reference is made to the following detailed description of various preferred embodiments thereof taken in conjunction with the accompanying drawings wherein:

FIG. 1 is a partially schematic, cross-sectional view of an embodiment of the image-recording element of the invention;

DETAILED DESCRIPTION OF THE PREFERRED EMBODIMENTS

The image-recording element of the invention will be described further in detail with respect to a preferred embodiment which includes a photosensitive element and a second element. The photosensitive and second elements are initially separate and following exposure are brought together in superposed relationship to allow development to take place. Subsequently, the image-recording element is separated into two members, each of which includes one of the complementary images formed during photographic development.

Referring now to FIG. 1, there is seen a preferred embodiment of an image-recording element 10 according to the invention comprising photosensitive element 12 and a second element 14. As illustrated, photosensitive element 12 includes a support layer 16, which may be transparent, opaque or translucent, image-receiving layer 18, strip-coat layer 20, first photosensitive silver halide layer which includes the silver reducing agent 22, second photosensitive silver halide layer 24 and overcoat layer 26.

Support layer 16 may be of any suitable material and may be transparent, opaque or translucent. The material must necessarily be able to withstand the heat applied for processing the image. Any suitable support can be employed such as those described in Research Disclosure No. 17029, issued June 1978. Specific examples of suitable supports include synthetic polymeric films, such as polyethylene terephthalate, polycarbonate, polyvinyl chloride, polystyrene, polyethylene, polypropylene, polyimide and polyethylene-2,6-naphthalene dicarboxylate. The above described supports can be made opaque by incorporating pigments therein such as titanium dioxide and calcium carbonate. Other supports include paper supports, such as photographic raw paper, printing paper, baryta paper and resin-coated paper having paper laminated with pigmented thermoplastic resins, fabrics, glass and metals. A subcoat may be added to the face of the support which carries the heat-developable photosensitive materials in order to increase adhesion. For example, a polyester base coated with a gelatin subcoat has been found to enhance adhesion of aqueous based layers.

Image-receiving layer 18 comprises any suitable material which is adapted to effect catalytic reduction of a soluble silver complex. The composition of silver precipitating layers is well known in the art, and a wide variety of silver precipitating materials, or nuclei, may be used in a wide variety of matrix, or binder, materials. Such silver precipitating nuclei include heavy metals and heavy metal compounds such as the metals of Groups IB, IIB, IVA, VIA and VIII, and the reaction products of metals of Group IB, IIB, IVA and VIII with elements of Group VIA. Typical suitable silver precipitating nuclei are disclosed in U.S. Pat. No. 2,698,237 including metallic sulfides and selenides. Also suitable as precipitating agents are heavy metals such as silver, gold, platinum and palladium. Noble metals are typically preferred and are generally provided in the binder matrix as colloidal particles. The matrix, or binder, material may comprise a colloidal material such as gelatin, carboxymethylcellulose, a siliceous material and mixtures thereof. A particularly preferred image-receiving layer comprises colloidal palladium dispersed in colloidal silicas. Typically, the silver nuclei are present in a range of from about 1 to about 10 mg/m$^2$ and the binder material in the range of from about 5 to about 500 mg/m$^2$. A preferred binder to nuclei ratio is from about 5:1 to about 100:1.

Strip-coat layer 20 is intended to facilitate the separation of the overlying layers from the image-receiving layer after processing and is designed, upon separation, to remain substantially completely with the photosensitive layer 22. The strip-coat layer is preferably very thin, for example, preferably having a thickness in the range of from 0.1 to about 0.5 μ. Suitable strip-coat layers may be prepared from a variety of hydrophilic colloid materials such as gum arabic, carboxymethylcellulose, hydroxyethylcellulose, polymethacrylic acid, polymers derived from ethylenically unsaturated carboxylic acids, e.g., acrylic acid, etc.

The photosensitive silver halide used in the photothermographic elements of the invention may be any photosensitive silver halide which is thermally processable such as silver chloride, iodide, bromide, iodobromide, chlorobromide, etc., and it may be prepared in situ or ex situ by any known method. Any type of silver halide emulsion may be utilized, for example, core shell, tabular as well as any of the variety of silver halide crystal shapes known in the art, for example, cubic and octahedral.

The photosensitive silver halide is typically prepared as an emulsion which is preferably an aqueous emulsion, and any conventional silver halide precipitation techniques may be employed in the preparation of the emulsions. The silver halide emulsions may be spectrally sensitized by any suitable spectral sensitization technique in order to extend the photographic sensitivity to wavelengths other than those absorbed by the unsensitized silver halide. Examples of typical suitable sensitizing materials include cyanine dyes, merocyanine dyes, styryl dyes, hemicyanine dyes and oxanole dyes. In addition to spectral sensitization, the silver halide emulsions may be chemically sensitized utilizing any known suitable chemical sensitization technique. Many chemical sensitization methods are known in the art.

In a preferred embodiment layers 22 and 24 include photosensitive silver halide. The silver halide emulsions are generally added to layers 22 and 24 in an amount calculated to provide a total coated coverage of silver halide in the range of from about 5 to about 20 mmol/m$^2$ and preferably from about 8 to about 15 mmol/m$^2$. In a particularly preferred embodiment about ⅔ of the total silver halide content is incorporated in layer 22 which contains the silver halide developer and about ⅓ in layer 24.

The silver halide emulsions incorporated in the photosensitive layers 22 and 24 may be the same or different, that is, the silver halide grains may be the same size and photographic speed or they may have different speeds, different halide compositions and different average grain sizes. It is preferred to utilize the same silver halide emulsion in layers 22 and 24. Where different silver halide emulsions are used in the respective silver halide layers it is preferred to incorporate the faster dissolving silver halide (smaller average grain size or one having a higher solubility constant - Ksp) in layer 24. Also, where two different silver halide emulsions are used, it is preferred to incorporate the less developable emulsion, i.e., that which has a lesser speed of development, in layer 24.

In another embodiment silver halide grains having higher speed can be incorporated in layer 22 and the slower silver halide grains in layer 24. It has been found that increased image densities can be obtained in this manner; however, experimentation has shown that the increase in image density becomes smaller as the speed of the silver halide grains in layer 22 becomes significantly faster than the speed of the silver halide grains in layer 24, for example, approximately 5½ times as light sensitive.

As mentioned previously, in another embodiment a substantially light-insensitive source of silver such as a silver salt may be utilized in the image-recording element. In this embodiment it is preferred to incorporate the light-insensitive silver salt in layer 24 and the photosensitive silver halide in layer 22.

The silver salt material should be relatively light stable and thermally stable under the processing conditions. The silver salt oxidizing material is generally an organic silver salt or silver salt complex as is known in the art. Any suitable organic compound which is useful for forming the organic silver salt may be employed. See, e.g., the organic silver salts described in U.S. Pat. No. 4,729,942. See U.S. Pat. No. 4,260,677 for useful silver salt complexes.

Examples of suitable silver salt materials include silver salts of carboxylic acids, e.g., behenic and stearic acids and silver salts of compounds having an imino group. Preferred silver salts are the organic silver salts having an imino group. The silver salts of benzotriazole and its derivatives have been found to give particularly good results in the heat-developable photosensitive systems of the present invention.

The silver salt used in the present invention can be prepared in a suitable binder by any known means and then used immediately without being isolated. Alternatively, the silver salt may be isolated and then dispersed in a suitable binder.

Any suitable silver halide solvent may be used such as, for example, sodium or potassium thiosulfate, sodium thiocyanate and uracil. Also, a silver halide solvent precursor may be used.

In the preferred embodiment illustrated in FIG. 1, layer 22 further includes the silver halide developer material, i.e. the silver reducing agent. Any suitable reducing agents may be used in the image-recording elements of the present invention, and these may be selected from among those commonly used in heat-developable photographic materials. Illustrative reducing agents useful in the present invention include hydroquinone and its derivatives, e.g., 2-chlorohydroquinone; aminophenol derivatives, e.g., 4-aminophenol and 3,5-dibromophenol; catechol and its derivatives, e.g., 3-methoxycatechol; phenylenediamine derivatives, e.g., N,N-diethyl-p-phenylenediamine; and, 3-pyrazolidone derivatives, e.g., 1-phenyl-3-pyrazolidone and 4-hydroxymethyl-4-methyl-1-phenyl-3-pyrazolidone. The preferred reducing agents are 1-phenyl-3-pyrazolidone, commercially available under the tradename Phenidone, 4-hydroxymethyl-4-methyl-1-phenyl-3-pyrazolidone, commercially available under the tradename Dimezone-S, and graphidones (4- methyl-1-phenylpyrazolidone). Also preferred are aminoreductones such as are disclosed in U.S. Pat. No. 5,427,905.

The reducing agents may be used singly or in combination and are generally employed in amounts ranging from about 5 to about 20 mmol/m$^2$, and preferably from about 8 to about 15 mmol/m$^2$.

The photosensitive silver halide emulsion layer(s) and other layers of the heat-developable photosensitive image-recording material may contain various materials as binders. Suitable binders include water soluble synthetic high-molecular weight compounds such as polyvinyl alcohol and polyvinylpyrrolidone, and synthetic or natural high-molecular weight compounds such as gelatin, gelatin derivatives, cellulose derivatives, proteins, starches and gum arabic. A single binder or mixture of binders may be used. Gelatin is the preferred binder for use in each layer. The amount of binder used in each layer is generally from about 0.5 to about 5.0 g/m$^2$, preferably from about 0.5 to about 2.0 g/m$^2$.

The layers of the heat-developable photosensitive system according to the present invention which contain a crosslinkable colloid as a binder, e.g., gelatin, can be hardened by using various organic and inorganic hardeners such as those described in T. H. James, *The Theory of the Photographic Process,* 4th Ed., MacMillan, 1977, pp. 77–87. The hardeners can be used alone or in combination. It is preferred that the image-recording elements according to the present invention contain a hardener in the photosensitive silver halide emulsion layer(s). Any suitable hardener may be used; however, aldehyde hardeners, e.g., succinaldehyde and glyoxal, have been found to be particularly useful when gelatin is employed as the binder. The hardeners are generally used in amounts ranging from about 1 to about 10% by weight of the gelatin coated.

Also shown is optional overcoat layer 24 which may be a protective layer and which may comprise a material such as gelatin in combination with a cross-linking material to prevent the gelatin from being softened during processing. Other materials such as slip additives and surfactants may be incorporated in this layer. In the preferred embodiment where an alkali-generating system is incorporated in the image-recording element to generate in situ the alkaline environment required for development, it is preferred to incorporate one of the reactants in layer 24, for example, a slightly water-soluble metal oxide or hydroxide such as zinc hydroxide.

The optional second element 14 comprises a support layer 28 which may be of any of the materials discussed previously with respect to support layer 16, layer 30 and overcoat layer 32. Where the alkali is generated in situ, it is preferred to incorporate another reactant, for example, a chelating material such as, for example, the sodium salt of ethylenediaminetetracetic acid which will react with zinc hydroxide to release hydroxyl ions in layer 32. An alkali-generating system of this type is described in U.S. Pat. No. 3,260,598. Various materials may be incorporated in layer 30 such as, for example, a silver solvent.

The photosensitive and second elements may be provided as a single integral image-recording element, or preferably they can be provided, as illustrated, as separate discrete elements. In the preferred embodiment where the alkali is generated in situ and the photosensitive and second elements are provided as separate discrete elements the photosensitive element is exposed, preferably through overcoat layer 24, as illustrated, by any of the methods typically used in the photographic art, e.g. a tungsten lamp, a mercury vapor lamp, a halogen lamp, fluorescent light, a xenon flash lamp, a light emitting diode including those which emit infrared radiation, etc.

Following exposure, an alkaline environment suitable for development of the exposed photosensitive silver halide material is created within the image-recording element. The alkaline environment may be created by distributing an aqueous alkaline processing composition between photosensitive element 12 and second element 14 such as from a rupturable container as is well known in the diffusion transfer photographic art. In the preferred embodiment where the alkaline material is generated in situ, a solvent, preferably water, is applied to the image-recording element to bring together the reactants which comprise the alkali-generating system. The water may be applied by any of various techniques such as dipping, spraying, distribution from a rupturable container, conventional bath processing etc. A thermal solvent may be incorporated in the image-recording element to serve as the fluid which permits diffusion to take place within the element. Typical suitable thermal solvents are discussed in U.S. Pat. No. 3,438,776 and EP 0 545 433.

Typically, from about 5 to about 55 g/m$^2$ of water are applied and preferably from about 10 to about 25 g/m$^2$.

In the preferred embodiment where the photosensitive element 12 and second element 14 are initially provided as separate discrete elements, it is preferred to apply the water to the exposed photosensitive element 12 before it is brought into superposed contact with the second element 14. The exposed and wet photosensitive element is then brought into contact with the second element such as by passing the elements through a pair of laminating rollers as is well known in the diffusion transfer photographic art.

The photosensitive image-recording elements of the invention are heat-developed after imagewise exposure. This is generally accomplished by heating the element at a temperature in the range of from about 80° C. to about 200° C., preferably from about 80° C. to about 120° C., for a period of from about 1 to about 720 seconds, preferably from about 5 to about 100 seconds. Heat may be applied alone or in combination with pressure, if necessary, to create good thermal contact between the photosensitive and second elements. Pressure can be applied simultaneously with the required heat for thermal development by using heated rollers or heated plates. Alternatively, heat and pressure, if required, can be applied subsequent to thermal development. Any method of heating that can be utilized with heat-developable photosensitive systems may be employed. For example, heating may be accomplished by using hot air, a hot plate, heated rollers, a hot drum, etc.

As described previously, the exposed silver halide is developed and remains in the photosensitive layer or layers, whereas the unexposed silver halide is complexed by the silver solvent and diffuses to image-receiving layer 18 where it is reduced to metallic silver at the nucleating sites to form a dense black positive image in that layer.

After development, the strip-coat layer 20, together with layers 22, 24, 26, 28, 30 and 32, is separated from image-receiving layer 18 to provide a dense, black positive silver image in image-receiving layer 18 carried by support 16. A transparency is provided where support 16 is transparent and a reflection print is provided where support 16 is a reflective substrate.

It should be noted here that the heat-developable, photosensitive image-recording elements of the invention may include other materials which are well known in the art for use in such elements. Such other materials include, for example, antifoggants, releasable antifoggants, antistatic agents, coating aids such as surfactants, activators and the like.

The invention will now be described further in detail with respect to specific preferred embodiments by way of examples, it being understood that these are intended to be illustrative only and the invention is not limited to the materials, procedures, amounts, etc. recited therein. All parts and percentages recited are by weight unless otherwise stated.

The compound represented by Formula A was used in the image-recording materials recited in the examples.

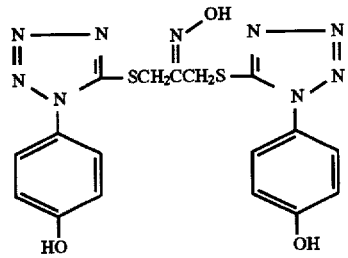

(A)

EXAMPLE I

A Control-1 image-recording element was prepared wherein the photosensitive element comprised an overcoated 76 μm thick clear polyester photographic film base having coated thereon in succession:

(1) an image-receiving layer coated at a coverage of about 2 mg/m$^2$ of palladium, about 2 mg/m$^2$ of gelatin and about 11 mg/m$^2$ of hydroxyethylcellulose (HEC)

(2) a layer coated at a coverage of about 12 mg/m$^2$ of copper acetate, about 35 mg/m$^2$ chitosan, about 56 mg/m$^2$ of gelatin, about 11 mg/m$^2$ of silicon dioxide, about 2 mg/m$^2$ of dithiodiglycolic acid and about 3.5 mg/m$^2$ of gold chloride;

(3) a layer coated at a coverage of about 65 mg/m$^2$ of HEC and about 22 mg/m$^2$ of polyethylene wax;

(4) a strip-coat layer coated at a coverage of about 110 mg/m$^2$ of carboxymethylcellulose (CMC);

(5) a layer coated at a coverage of about 43 mg/m$^2$ of aluminum potassium sulfate;

(6) a photosensitive silver halide layer coated at a coverage of about 1075 mg/m$^2$ of an unsensitized 0.23 μ silver bromide, about 1850 mg/m$^2$ of Graphidone, about 110 mg/m$^2$ of compound A; and about 1075 mg/m$^2$ of gelatin; and (7) an overcoat layer coated at a coverage of about 540 mg/m$^2$ of gelatin, about 1400 mg/m$^2$ of zinc hydroxide and about 43 mg/m$^2$ of succinaldehyde.

A second element was prepared which comprised a clear subcoated 102 μm thick polyester photographic film base having coated thereon:

(1) a layer coated at a coverage of about 2000 mg/m$^2$ of gelatin, about 4000 mg/m$^2$ of N-2-(hydroxyethyl) ethylenediamine triacetic acid, sodium salt, about 65 mg/m$^2$ of (p-hydroxyphenyl) mercaptotetrazole, about 100 mg/m$^2$ of sodium sulfate and about 1100 mg/m$^2$ sodium thiosulfate; and (2) an overcoat layer coated at a coverage of about 500 mg/m$^2$ of gelatin, about 870 mg/m$^2$ of 6-methylthiomethyluracil and about 250 mg/m$^2$ of 14 nm particles of colloidal silica and about 50 mg/m$^2$ succinaldehyde.

The photosensitive element was exposed ($10^{-3}$ sec) to a gray scale step wedge with white light (30 mcs) and immersed for 5 seconds in water at room temperature. Upon removal from the water, the photosensitive element was brought into superposed contact with the second element and the combination passed through a zero gap set of rubber rollers. Subsequently, the image-recording element was heated at 90° C. with a waffle iron for 30 seconds.

The image-recording element was then separated into two parts by separating the strip-coat layer from the image-receiving layer. The image density of the silver image which was formed on the image-receiving layer was measured with an XRite Model 310 Photographic Densitometer. The results are shown in Table I.

A Control-2 image-recording element was prepared which had 1.5 times the saver halide in one layer as Control-1. The Control-2 element was identical to Control-1 with the exception that layers 6 and 7 of the photosensitive element were coated as follows:

(6a) photosensitive saver halide layer coated at a coverage of about 1615 mg/m$^2$ of an unsensitized 0.23 μ silver bromide, about 2775 mg/m$^2$ of Graphidone, about 161 mg/m$^2$ of Compound A and about 1615 mg/m$^2$ of gelatin;

(7a) an overcoat layer coated at a coverage of about 540 mg/m$^2$ of gelatin, about 2100 mg/m$^2$ of zinc hydroxide and about 43 mg/m$^2$ of succinaldehyde.

The Control-2 image-recording element was processed as described above.

The Control-1 and Control-2 image-recording elements are within the subject matter claimed in pending, commonly assigned U.S. patent application of William J. Pfingston Ser. No. 08/607,682, now abandoned filed on even date herewith.

An image-recording element (A) according to the invention was prepared wherein the photosensitive element had the same support and layers 1–5 as Control-1 with the following layers.

(6) a photosensitive silver halide layer coated at a coverage of about 1075 mg/m$^2$ of an unsensitized 0.23 μ silver bromide, about 1075 mg/m$^2$ of gelatin, about 2775 mg/m$^2$ of Graphidone, and about 161 mg/m$^2$ of compound A;

(7) a photosensitive silver halide layer coated at a coverage of about 540 mg/m$^2$ of an unsensitized 0.23 μ silver bromide, and about 540 mg/m$^2$ of gelatin; and (8) an overcoat layer coated at a coverage of about 2100 mg/m$^2$ of zinc hydroxide, about 540 mg/m$^2$ of gelatin and about 48 mg/m$^2$ of succinaldehyde.

Image-recording elements B and C according to the invention were prepared. These were substantially identical with element A with the exception that element B had 540 mg/m$^2$ of silver benzotriazole in layer 7 and element C had 540 mg/m$^2$ of 1 μ×1.0 μ unsensitized tabular silver bromide in layer 7.

TABLE I

| | Image Density | |
|---|---|---|
| Element | Dmax | Dmin |
| Control-1 | 1.80 | 0.06 |
| Control-2 | 2.10 | 0.15 |
| A | 2.95 | 0.04 |
| B | 3.05 | 0.04 |
| C | 2.70 | 0.04 |

These data show that simply increasing the mount of silver halide in one layer of the element (Control-2) does not provide as large an image density increase as was obtained when the increased mount of silver halide was arranged in two separate layers (element A) in accordance with the invention.

The data also show that using a light-insensitive silver source (AgBZt in element B) in accordance with the invention provides a significant image density increase in the same manner as using the same silver halide for both light capture and final image density (element A).

EXAMPLE II

Control image-recording elements 1*a* and 2*a* and image-recording elements D–F were prepared which were identical to Control elements 1 and 2 and elements A–C, respectively, with the exception that layer (1) of the second element included about 6000 mg/m$^2$ of (N-2-hydroxyethyl) ethylenediamine triacetic acid, sodium salt, about 1650 mg/m$^2$ of $Na_2S_2O_3$ and about 405 mg/m$^2$ (p-hydroxyphenyl) mercaptotetrazole and layer (2) included about 1305 mg/m$^2$ of 6-methylthiomethyluracil.

TABLE II

| | Dmax | Dmin |
|---|---|---|
| Control-1a | 1.95 | 0.22 |
| Control-2a | 2.20 | 0.40 |
| D | 2.85 | 0.04 |
| E | 2.85 | 0.04 |
| F | 2.70 | 0.06 |

These data confirm the results obtained in Example I.

EXAMPLE III

This experiment compares a Control-3 element which had all the silver halide in one layer with image-recording elements according to the invention which had the entire amount of silver halide divided equally between two adjacent layers.

The Control-3 element was identical to the Control-1 element with the exception that layers 6 and 7 of the photosensitive element were coated as follows:

(6) photosensitive silver halide layer coated at a coverage of about 1615 mg/m$^2$ of an unsensitized 0.23 μ silver bromide, about 1615 mg/m$^2$ of gelatin, about 1850 mg/m$^2$ of graphidone and about 110 mg/m$^2$ of compound A;

(7) an overcoat layer coated at a coverage of about 540 mg/m$^2$ of gelatin, about 1400 mg/m$^2$ of zinc hydroxide and about 43 mg/m$^2$ of succinaldehyde.

Image-recording element G was identical to image-recording element A with the exception that layers 6–8 of the photosensitive element were coated as follows:

(6) a photosensitive silver halide layer coated at a coverage of about 1075 mg/m$^2$ of gelatin, about 807 mg/m$^2$ of an unsensitized 0.23 μ silver bromide, about 1850 mg/m$^2$ of graphidone and about 110 mg/m$^2$ of compound A;

(7) a photosensitive silver halide layer coated at a coverage of about 540 mg/m$^2$ of gelatin and about 807 mg/m$^2$ of an unsensitized 0.23 μ silver bromide; and (8) an overcoat layer coated at a coverage of about 540 mg/m$^2$ of gelatin, about 1400 mg/m$^2$ of zinc hydroxide and about 43 mg/m$^2$ of succinaldehyde and layer 1 of the second element included 270 mg/m$^2$ of (p-hydroxyphenyl) mercaptotetrazole.

The elements were processed as described above.

TABLE III

| | IMAGE DENSITY | |
|---|---|---|
| ELEMENT | Dmax | Dmin |
| Control-3 | 2.80 | 0.05 |
| G | 3.05 | 0.05 |

EXAMPLE IV

This experiment compared silver halide emulsions of different speeds in image-recording elements of the invention with control elements.

A Control-4 image-recording element was prepared which was identical to Control-1 with the exception that layers 6 and 7 of the photosensitive element were coated as follows:

(6) a photosensitive silver halide layer coated at a coverage of about 500 mg/m$^2$ of 0.23 μ unsensitized silver bromide, about 1075 mg/m$^2$ of an unsensitized 0.5 μ silver iodobromide (1% Iodide), about 1500 mg/m$^2$ of gelatin, about 1850 mg/m$^2$ of graphidone and about 110 mg/m$^2$ of compound A;

(7) an overcoat layer coated at a coverage of about 540 mg/m$^2$ of gelatin, about 1400 mg/m$^2$ of zinc hydroxide and about 41 mg/m$^2$ of succinaldehyde.

The speed difference between the primitive emulsion was approximately 2.5 stops (the iodobromide grains were approximately 5.5 times as light sensitive as the bromide grains).

Image-recording element H according to the invention was prepared which had the same support and layers 1–5 as Control-4 with the following layers:

(6) a photosensitive silver halide layer coated at a coverage of about 1000 mg/m$^2$ of gelatin, about 1075 mg/m$^2$ of the unsensitized 0.5 μ silver iodobromide, about 1850 mg/m$^2$ of graphidone and about 110 mg/m$^2$ of compound A:, (7) a photosensitive silver halide layer coated at a coverage of about 500 mg/m$^2$ of gelatin, and about 540 mg/m$^2$ of the unsensitized 0.23 μ silver bromide; and (8) an overcoat layer coated at a coverage of about 540 mg/m$^2$ of gelatin, about 1400 mg/m$^2$ of zinc hydroxide and about 41 mg/m$^2$ of succinaldehyde.

A Control-5 element was prepared which was identical to Control-4 with the exception that the respective mounts of the two silver halide gains were reversed, i.e., layer 6 included about 1075 mg/m$^2$ of 0.23 μ silver bromide and about 500 mg/m$^2$ of 0.5 μ silver iodobromide.

Image-recording element I according to the invention was prepared which was identical to dement H with the exception that layer 6 included about 1075 mg/m$^2$ of 0.23 μ silver bromide and layer 7 included about 500 mg/m$^2$ of 0.5 μ silver iodobromide.

TABLE IV

| | IMAGE DENSITY | |
|---|---|---|
| ELEMENT | Dmax | Dmin |
| Control-4 | 2.62 | 0.05 |
| H | 2.93 | 0.05 |
| Control-5 | 2.56 | 0.04 |
| I | 2.63 | 0.04 |

These data show that arranging faster silver halide below slower silver halide in accordance with the invention provides a large increase in image density. Also the data show that increased image density can be obtained by arranging the faster (or more developable and less soluble) silver halide grains above the slower silver halide, however the increase becomes smaller as the speeds of the faster silver halide become significantly faster than the slower silver halide.

Although the invention has been described with respect to specific preferred embodiments, it is not intended to be limited thereto, but rather those skilled in the art will recognize that modifications and variations may be made thereon which are within the spirit of the invention and the scope of the appended claims.

What is claimed is:

1. A heat-developable image-recording element comprising a first support and an optional second support and carried by said first support or confined between said first and second supports a silver solvent, a silver reducing agent, an image-receiving layer comprising silver nucleating material, a first layer including photosensitive silver halide adjacent to a second layer including photosensitive silver halide, wherein said first layer includes said silver reducing agent and said second layer does not include any silver reducing agent and said first layer is closer to said image-receiving layer than said second layer.

2. The image-recording element as defined in claim 1 wherein said photosensitive silver halide of said first layer is the same as said photosensitive silver halide of said second layer.

3. The image-recording element as defined in claim 2 wherein about two-thirds of the combined amount of photosensitive silver halide in said first and second layers is present in said first layer and about one-third is present in said second layer.

4. The image-recording element as defined in claim 1 and further including means for providing alkali.

5. The image-recording element is defined in claim 4 wherein said means for providing alkali includes two reactants which are capable of reacting to form an alkali.

6. The image-recording element as defined in claim 1 which includes said second support and said image-receiving layer is carried by said second support.

7. A heat-developable image-recording element comprising a first element comprising a support carrying a first layer including photosensitive silver halide adjacent to a second layer including photosensitive silver halide, and wherein said first layer includes a silver reducing agent and said second layer does not include any silver reducing agent;

a second element comprising a support carrying an image-receiving layer and in superposed or superposable relationship with said first element, wherein said first layer of said first element is closer to said image-receiving layer of said second element than said second layer of said first element;

a silver solvent located in at least one of said first and second elements; and means for providing alkali to said first and second elements.

8. The image-recording element as defined in claim 7 wherein said means for providing alkali includes two reactants which are capable of reacting to form an alkali, one of said reactants being present in said first element and the other of said reactants being present in said second element.

9. The image-recording element as defined in claim 7 wherein said photosensitive silver halide of said first layer is the same as said photosensitive silver halide of said second layer.

10. The image-recording element as defined in claim 7 wherein said second element further includes a strip-coat layer positioned on the surface of said image-receiving layer remote from said support.

11. The image-recording element as defined in claim 9 wherein about two-thirds of the combined amount of photosensitive silver halide is present in said first layer and about one-third is present in said second layer.

* * * * *